United States Patent [19]

Kettlestrings

[11] 4,119,316

[45] Oct. 10, 1978

[54] MAGNETIC DART TOY

[75] Inventor: John S. Kettlestrings, Glendale Heights, Ill.

[73] Assignee: Cling-Cal Corporation, Carol Stream, Ill.

[21] Appl. No.: 774,703

[22] Filed: Mar. 4, 1977

[51] Int. Cl.[2] ..... A63B 65/02; F41J 3/00

[52] U.S. Cl. ..... 273/95 R; 273/102 R; 273/106.5 B; 273/106.5 C

[58] Field of Search ..... 273/95 R, 102 R, 102 PM, 273/102 S, 106 F, 106.5 R, 106.5 A, 106.5 B, 106.5 C, 106.5 D

[56] References Cited

U.S. PATENT DOCUMENTS

| | | | |
|---|---|---|---|
| 1,009,640 | 11/1911 | Borges | 273/106.5 R |
| 2,280,441 | 4/1942 | Mull | 273/106.5 A |
| 2,477,531 | 7/1949 | Volman | 273/102 R |

*Primary Examiner*—William H. Grieb

*Attorney, Agent, or Firm*—Hill, Gross, Simpson, Van Santen, Steadman, Chiara & Simpson

[57] ABSTRACT

An aerodynamic dart toy for amusement of children and adults includes a dart body having a blunt magnetic nose and a lightweight aerodynamic body formed in one piece by selective folding of a die cut flat sheet material. The device can be manually propelled over a significant distance to strike a metal target and attach itself thereto.

9 Claims, 7 Drawing Figures

Fig. 1
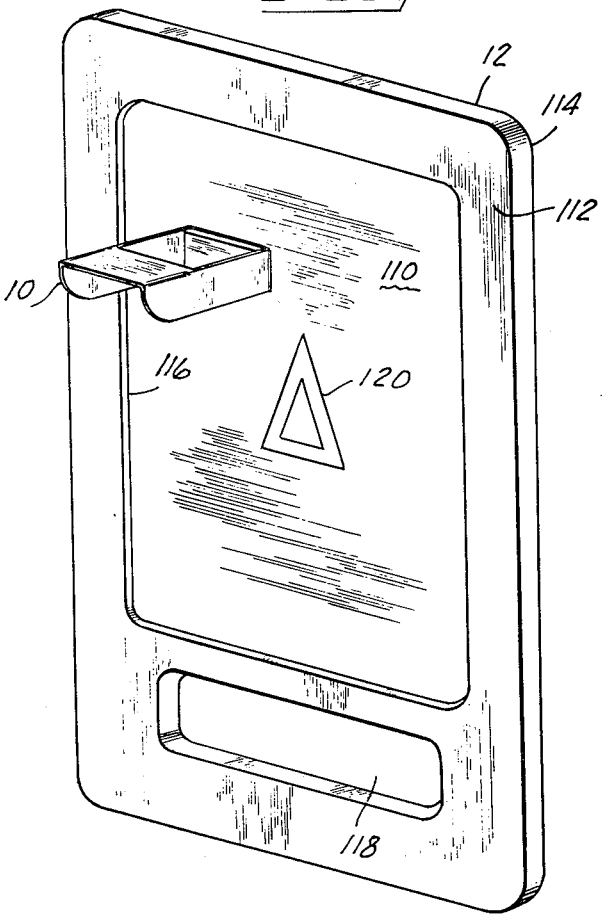
Fig. 6
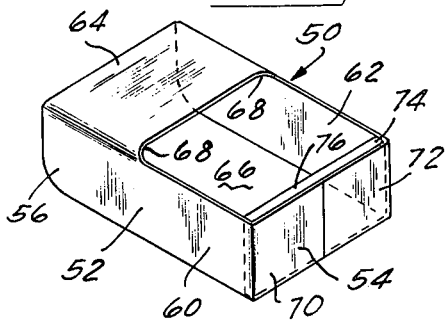
Fig. 7
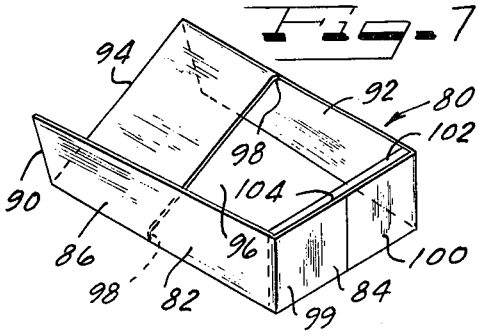
Fig. 2
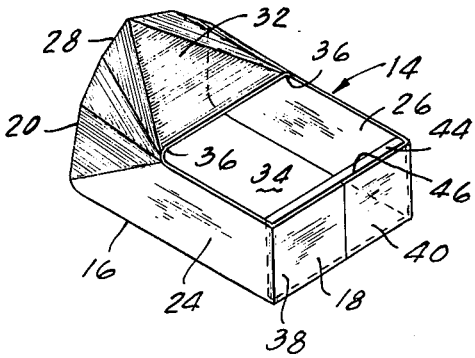
Fig. 3
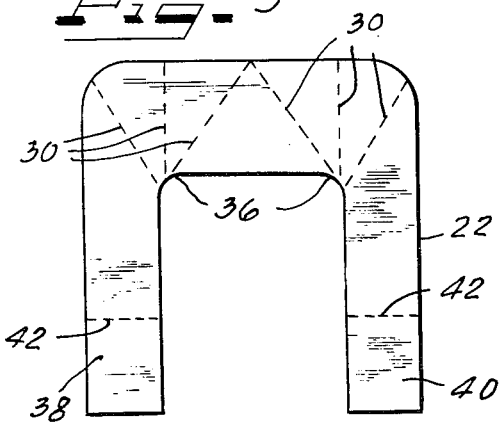
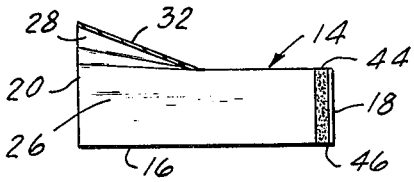
Fig. 5
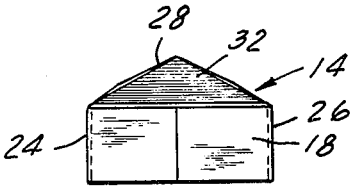
Fig. 4

MAGNETIC DART TOY

BACKGROUND OF THE INVENTION

1. Field of the Invention

This invention relates to toys and particularly to aerodynamic dart toys which can be propelled through the air to strike a distant target.

2. Description of the Prior Art

Darts for use in games of skill and amusement have long been known. The typical dart has an elongated missle-shaped body with a point-shaped nose tip and guidance surfaces such as feathers attached to the rear of the body. Such a dart can be thrown manually at a dart board made of a sufficient soft material such as cork to allow the tip of the dart to penetrate the material and be retained thereby. The board can be provided with various designs such as a bull's eye to allow measurement of the accuracy of the throw to provide a game to be played between competing players or teams.

A major disadvantage of the conventional dart is the damage of the needle-like nose to both the user and a bystander. Likewise, the surface on which the target is supported is subject to damage if the dart inadvertently fails to hit the target. A dart of this configuration is not considered safe for use by smaller children.

Many modifications of the construction of the dart and the means of propelling such are available. Darts having a magnetic tip or a VELCRO tip where the target is either metal or of a like VELCRO material to provide retention of the dart upon impact are also known.

Darts to be propelled in a blow-gun fashion by inserting such in a tube and applying a breath of air to the end of the tube are also available.

SUMMARY OF THE INVENTION

A dart incorporating the invention herein disclosed comprises a body having a flat rectangular-shaped nose and a lightweight aerodynamic rear body portion. The body is in part made by the selective folding of a die cut piece of flat stock to form two vertical spaced sides and a partial crosspiece therebetween. The die cut piece includes two nose tabs which are folded inwardly to cover a magnetic element and be joined thereto by a suitable mastic. The magnetic element is likewise cut from a sheet of magnetic impregnated flat stock.

The dart disclosed above has many advantages over previously known darts.

First, and most importantly, it is injury resistant because its lightweight body weights but a fraction of an ounce and it has a blunt nose configuration.

Secondly, its construction is usually simple and therefore provides an inexpensive toy to be enjoyed by many.

Thirdly, the dart has excellent aerodynamic characteristics allowing a user to propel the dart accurately up to ten feet at a distant target. Because of its flexible and lightweight body, the magnetic nose adheres to a distant target even when the angle of impact is oblique.

Another major advantage to the dart of this invention is its nonmarking quality. Heretofore, darts with a needlelike tip could do substantial damage to surrounding surfaces on contact. A magnetic tip dart as now known also marks painted metal surfaces because of the inherent marking characteristics of the components used to make inexpensive magnets.

Because the magnetic nose portion is covered by the body portion, contact between the target and the magnetic nose portion on impact is minimized so as to allow the use of, as an example, a refrigerator door or metal cabinet as a target or target support surface without particular attention being paid to injury of that surface.

BRIEF DESCRIPTION OF THE DRAWINGS

FIG. 1 is a perspective view of the dart of the invention attached to a typical target.

FIG. 2 is a perspective view of a first configuration of a dart of this invention.

FIG. 3 is a detailed layout of a die cut piece from which in part a body portion of the dart of FIG. 4 is formed.

FIG. 4 is a front view of the dart of FIG. 2.

FIG. 5 is a side cross-sectional view of the dart of FIG. 2.

FIG. 6 is a perspective view of a second configuration of a dart of this invention.

FIG. 7 is a perspective view of a third configuration of a dart of this invention.

DETAILED DESCRIPTION OF THE PREFERRED EMBODIMENT

As shown in FIG. 1 is a typical dart 10 attached to a typical target 12.

As shown in FIG. 2 is a first dart configuration 14 having a box-shaped body 16 comprising a blunt magnetic nose portion 18 and a rear body portion 20. The body 16 is in part formed from a die cut 22 of the plasticized tear resistant paper. The die cut 22 is shown in FIG. 3.

The rear body portion 16 is in part formed by selective folding of the die cut piece 22 and includes two vertically spaced sides 24 and 26 separated by a dome-shaped crosspiece 28 formed by a partial folding of the die piece 22 along fold lines 30 to create a plurality of triangular segments 32.

Between the magnetic nose portion 18 and the crosspiece 28 is an opening 34 having radius corner 36 to resist tearing of the rear body portion 20 in the corner 36.

The magnetic nose portion 18 is formed by an inward folding of nose tabs 38 and 40 along fold lines 42 to cover a front vertical surface of a rectangular-shaped magnetic element 44 and be affixed thereto with a suitable mastic to form a joint 46.

A dart 50 of a second configuration is shown in detail in FIG. 6 and includes a box-shaped body 52 having a flat rectangular-shaped nose portion 54 and rear body portion 56.

The body 52 is formed in part from a die cut piece (not shown) having a U-shaped configuration. The piece is cut from a similar commercially available impregnated paper as the die cut 22 of the dart 14.

The body 52 is formed by a selective folding of the die cut piece to form two vertically spaced sides 60 and 62 and a partial top surface or crosspiece 64 joining a rear portion of each of the spaced sides 60 and 62 to create an opening 66 behind the nose portion 54. The opening 66 is likewise provided with radius corners 68 to resist tearing therein.

The die cut piece from which the body 52 is formed in part, further includes two nose tabs 70 and 72 which are folded inwardly to cover a rectangular-shaped magnetic element 74 formed by die cutting a flat sheet of commercially available magnetic impregnated plastic material. The tabs 70 and 72 are joined to a front surface of the element 74 with a suitable mastic to form a rigid joint 76.

Because the body 52 is formed by folding a flat piece of sheet material, the crosspiece 64 takes a slightly upward bowed configuration.

As is shown in FIG. 7 is a third configuration of a dart 80 having improved aerodynamic characteristics and including a body 82 comprising a blunt-nose portion 84 and a rear body portion 86. The body 82 is formed in part from a die cut piece (not shown) of a like flat stock plastic impregnated paper. The dart body 82 is formed by selective folding of the die piece and includes spaced sides 90 and 92 joined by a rear crosspiece 94 which extends from a bottom edge of side 90 to a top edge of side 92 to create an opening 96 between the crosspiece 94 and the nose portion 84.

The opening 96 is provided with radius corners 98 at the joinder of the sides 90 and 92 and the crosspiece 94 to make that joinder tear resistant.

The die cut piece includes two nose tabs 99 and 100 which together with a rectangular-shaped magnetic element 102 form the nose portion 84 of the dart 80 when the tabs 99 and 100 are folded inwardly and secured to a front surface of the element 102 and affixed thereto with a suitable mastic to form a rigid joint 104.

Because of the inherent resiliency of the plasticized paper from which the die piece is cut, sides 90 and 92 will flare outwardly from the nose 84.

The target 12 includes a magnetic sensitive insert 110 affixed between two outer portions 112 and 114 provided with a first cutout 116 to expose the insert 110 and a second finger gripping cutout 118.

A game can be created by a holder of the target 12 selectively positioning the target 12 so that the dart 10, as an example, strikes and attaches to the insert 110 as close as possible to an indicia 120 on the surface of the insert 110.

The dart, whether of the first, second or third configuration, can be easily propelled with accuracy up to ten feet. A user holds the nose portion, as an example, the nose portion 18 of the first dart configuration 14, between the thumb and middle finger and places the index finger on the rear vertical surface of the magnetic element 44 and then throws the dart 10 at a magnetic target, as an example, the target 12.

The weight of the nose portion, as an example, the nose portion 18 of the dart 10, in relation to the weight of the rear body portion 20 is such that the center of gravity of the dart 10 is located proximately aligned with a rear surface of the magnetic element 44.

The proportion of the dart, as an example, dart 10, has been found to be extremely important in obtaining stable flight characteristics when taken in consideration of the location of the center of gravity. Best results are obtained in using an approximate 2 to 1 ratio of the width of the nose portion 18 to its height. Further, the ratio of the length of the dart, as an example, dart 10, to its width has been determined to be optimized when the ratio proximates 1.7 to 1. Further, the ratio of the top opening 34 to the crosspiece 28 should proximate 1 to 1.

Because of the opening 34, sides 24 and 26 are most flexible behind the nose portion 18 so as to allow the nose portion 18 to flatten against a like flat target surface upon impact even when that contact is oblique. The same condition also exists for the second and third dart configurations 50 and 80.

When not in use, first and second dart configurations 14 and 50 can be conveniently stacked and stored in a rigid container to prevent damage thereto. The dart 80, of the third configuration, must be stored in a larger container since its configuration does not lend itself to such stacking.

While various modifications may be suggested by those versed in the art, it should be appreciated that I wish to embody within the scope of the patent warranted hereon, all such modifications as reasonably and properly come within the scope of my contribution to the art.

I claim as my invention:

1. A dart for use in a game or other amusement activity comprising, (a) a dart body, (b) a rectangular-shaped magnetic element having a front vertical surface forming a nose portion and carried by said body, and (c) a rear box-shaped body portion joined to said nose portion and having two spaced vertical sides joined to and separated by a partial crosspiece to create a selectively sized opening defined by said sides, said crosspiece and said nose portion, said body and said body portion being formed by a single piece of paper-like material cut and folded to provide said crosspiece as said body and said sides extending rearwardly to form said box-shaped body portion.

2. An aerodynamic dart for manual propulsion into flight comprising:

(a) a dart body having a single die cut piece of a thin flat stock of a tear-resistant paper-like material having a U-shaped configuration selectively folded to create two vertical sides separated by a rear crosspiece, two inwardly protruding nose tabs, and an opening between said tabs and said crosspiece, and (b) a rectangular-shaped magnetic nose carried by said body on said tabs and having a front vertical surface of selective width and a selective height, said width to said height having a ratio proximating 1 to 2, said nose having a first selective weight, and said rear body portion having a second selective weight, said first weight to said second weight being such as to position a center of gravity of said dart body to proximately align with a rear vertical surface of said magnetic nose, (c) said dart having a selective length, said length to said width having a ratio proximating 1.7 to 1.

3. A dart toy for safe use by a young child and the like comprising, (a) a single die cut piece of a thin flat stock of a tear resistant paper-like material having a U-shaped configuration selectively folded to create two vertical sides separated by a rear crosspiece, two inwardly protruding nose tabs, and an opening between said tabs and said crosspiece, and (b) a flat rectangular-shaped magnetic element having a front vertical surface joined to an inner surface of said tabs to form a nonmarking, injury resistant magnetic nose portion, wherein said dart can be manually propelled into flight by a user holding said magnetic nose of said dart and throwing such toward a magnetic sensitive surface without undue risk of injury to the user and others in the proximity of the user.

4. A dart toy of claim 3 and further including, a target comprising a target body having a flat metallic exposed surface carried by said body between two outer support portions and a finger opening in said body to provide manual manipulation of said target.

5. A dart of claim 3 and further characterized by, said crosspiece being substantially flat and having end portions joining a top edge of said sides respectively, wherein a plurality of said darts can be conveniently stacked and stored during a period of nonuse.

6. A dart of claim 3 and further characterized by, said crosspiece being substantially flat and having an end portion joining a top edge of one of said sides and an opposite end portion joining a bottom edge of said other side, wherein said crosspiece provides improved aerodynamic stability to said flight of said dart.

7. A dart of claim 3 and further characterized by, said crosspiece being substantially dome-shaped, said dome formed by selective folding of said crosspiece into a plurality of triangular-shaped segments, wherein a plurality of said darts can be conveniently stacked and stored during a period of nonuse.

8. A dart of claim 3 and further characterized by, said opening between said tabs and said crosspiece having a tear resistant radius corner formed at a junction of said crosspiece and said sides respectively.

9. A game comprising, means forming a target surface of magnetic sensitive material, and a dart adapted to be selectively adhered to said surface and more specifically comprising, (a) a single die cut piece of a thin flat stock of a tear-resistant paper-like material having a U-shaped configuration selectively folded to create two vertical sides separated by a rear crosspiece, two inwardly protruding nose tabs, and an opening between said tabs and said crosspiece, and a dart body having a blunt magnetic nose for engaging said surface, and comprising, (b) a flat rectangular-shaped magnetic element having a front vertical surface joined to an inner surface of said tabs to form a nonmarking, injury-resistant magnetic nose portion, and a lightweight aerodynamic body formed in one piece by selective folding of said paper-like material, wherein said dart can be manually propelled into flight by a user holding said magnetic nose of said dart and throwing such toward a magnetic sensitive surface without undue risk of injury to the user and others in the proximity of the user.

* * * * *